US007458553B2

(12) United States Patent
Tzur et al.

(10) Patent No.: US 7,458,553 B2
(45) Date of Patent: Dec. 2, 2008

(54) ROLL STOCK CRADLE STRUCTURE

(75) Inventors: Gil Tzur, Kibbutz Mishmar Ha'Emek (IL); Jacob Agayof, Kibbutz Mishmar Ha'Emek (IL); Ronen Lin, Kibbutz Mishmar Ha'Emek (IL)

(73) Assignee: Tama Plastic Industry, Mishmar Ha'Emek (IL)

( * ) Notice: Subject to any disclaimer, the term of this patent is extended or adjusted under 35 U.S.C. 154(b) by 618 days.

(21) Appl. No.: 10/526,313

(22) PCT Filed: Sep. 4, 2003

(86) PCT No.: PCT/IL03/00730

§ 371 (c)(1),
(2), (4) Date: Mar. 2, 2005

(87) PCT Pub. No.: WO2004/022439

PCT Pub. Date: Mar. 18, 2004

(65) Prior Publication Data

US 2005/0247828 A1 Nov. 10, 2005

(30) Foreign Application Priority Data

Sep. 4, 2002 (IL) ..... 151599

(51) Int. Cl.
*A47G 29/00* (2006.01)

(52) U.S. Cl. ..... 248/346.02; 248/346.4

(58) Field of Classification Search ..... 248/346.4, 248/67, 68.1, 346.02; 229/100; 206/391, 206/394, 443, 593, 389, 523, 585, 587, 597, 206/419, 519
See application file for complete search history.

(56) References Cited

U.S. PATENT DOCUMENTS

| | | | | |
|---|---|---|---|---|
| 1,921,228 | A * | 8/1933 | Hetherington | 206/585 |
| 2,611,495 | A * | 9/1952 | Weaver | 410/42 |
| 2,698,696 | A * | 1/1955 | Strong | 206/598 |
| 3,476,260 | A * | 11/1969 | Jay | 206/503 |
| 4,195,732 | A | 4/1980 | Bell | |
| 4,832,196 | A | 5/1989 | Butler | |
| 5,080,314 | A * | 1/1992 | Moyer et al. | 248/346.4 |
| 5,735,412 | A * | 4/1998 | Sheckells | 211/59.4 |
| 6,209,839 | B1 | 4/2001 | O'Malley | |
| 6,474,613 | B2 * | 11/2002 | O'Malley | 248/346.02 |
| 7,044,358 | B2 * | 5/2006 | Gratz | 229/100 |

FOREIGN PATENT DOCUMENTS

| | | |
|---|---|---|
| DE | 19908621 | 9/2000 |
| EP | 0706949 | 4/1996 |
| WO | 9744220 | 11/1997 |

* cited by examiner

*Primary Examiner*—Korie Chan
(74) *Attorney, Agent, or Firm*—Dennison, Schultz & MacDonald

(57) ABSTRACT

Roll stock cradle support structure for receiving and supporting one or more pieces of roll stock, comprising: a flat base strip of rigid or semi-rigid plastic material having an upper and lower surface, at least one set of facing cradle portions of pre-selected dimensions integrally formed on one base strip surface, forming a roll support cradle, said cradle portions comprising a substantially vertical end wall and an arcuately shaped segment of rigid or semi-rigid plastic material, said segment being reinforced by members connecting the arcuately shaped segments with the end wall or base strip.

10 Claims, 3 Drawing Sheets

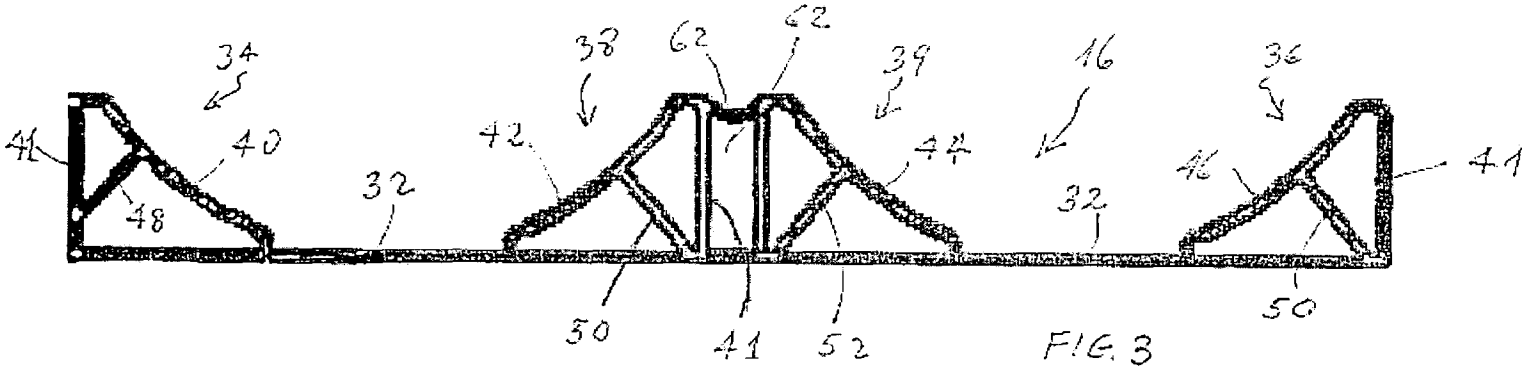
FIG. 3
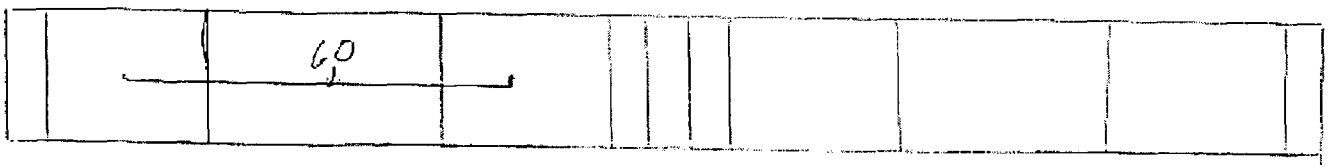
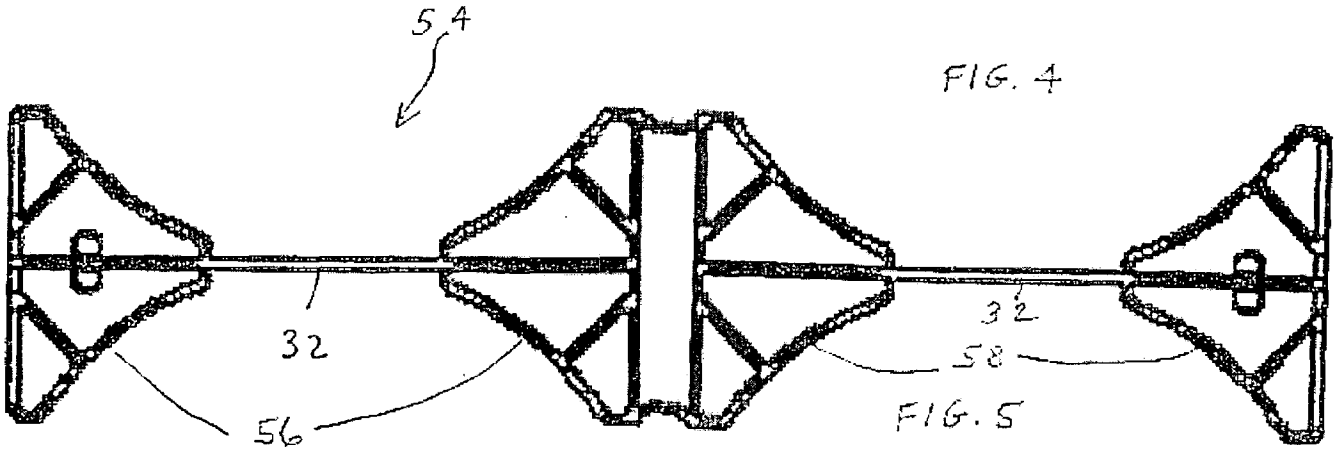
FIG. 4
FIG. 5

ROLL STOCK CRADLE STRUCTURE

This application is a filing under 35 USC 371 of PCT/IL2003/000730 filed Sep. 4, 2003.

FIELD OF THE INVENTION

The present invention relates to a roll stock cradle support structure for supporting horizontally lying cylinders, such as roll stock and the like, that allows their stacking, and to stacking systems incorporating such supporting cradles.

BACKGROUND OF THE INVENTION

There is frequently a need for storing and transporting round elongated objects, such gas cylinders, drums, and particularly 'roll stock'—cylindrical rolls of thin materials such as fabrics, polymer films, nets, paper products, aluminium foils and the like. Typically, roll stock is shipped and stored on pallets in horizontally oriented tiers. To stabilize and support these rolls in their tiers, stacking support structures are employed.

Typically, such support structures are made from cheap wood. Where heavy roll stock is transported using such wooden stacking supports, it has been found that such supports are subject to breakage during lifting and transportation, with an inherent risk of damage to the roll stock. Wooden roll supports have a tendency of splinter, and haulers are at risk from injury. Furthermore, wooden roll supports are not flexible and cannot accommodate rolls of varying diameters. Moreover, they are bulky, wasteful of natural resources, and are not cheap to manufacture. Wooden supports must also be protected from the elements, and, in many instances require treating the wood with pesticides, which of course, increases the unit cost. These supports cannot be stored outdoors in wet weather, since the wood will rot or warp.

Thus there has been a constant desire to replace wooden stacking supports, and numerous patents address this problem. U.S. Pat. No. 4,195,732 to Bell, and U.S. Pat. No. 4,832,196 to Butler, for example, both describe roll support members formed of expanded polystyrene foam. Expanded polystyrene is lightweight and does not produce splinters. However, there are other problems associated with expanded polystyrene roll stock supports, such as their brittleness and poor strength as well as their bulkiness. These supports are easily broken and take up significant storage space when unused.

In an apparent attempt to improve upon the inadequacies of polystyrene foam, U.S. Pat. No. 5,080,314 to Moyer, discloses a roll support structure formed from recyclable papier-mache. Although less brittle than expanded polystyrene and easier to dispose of, since papier-mache disintegrates when wet, such supports cannot be used in humid environments and always must be protected from weather, which is especially difficult while transporting, unless in closed containers. Papier-mache supports must also be fabricated with substantial thickness to support heavy roll stock, and therefore, they are bulky and require a lot of storage space indoors.

U.S. Pat. No. 6,209,839 to O'Malley, describes nestable cradle supports for stacking roll stock fabricated from polyethylene terephthalate (PET). Such supports are both compact and easily fabricable, and by virtue of their stackability, they are easily transportable. PET is also resistant to the elements allowing these supports to be stored outdoors. The supports described are fabricated as double strips, which may be folded lengthwise. The double strips are used as base supports for a first tier of roll stock and the folded strips for further stacking additional rolls on top of the first tier. The roll stock supports disclosed in this patent, however, have several disadvantages. First of all, PET is not a particularly cheap feedstock polymer. Secondly, the cradles of the support structures are resistant to deformation and each cradle within the support must be sized for the particular roll diameter to be stacked. Such a rigid structure is advantageous for stacking identical rolls such as rolls of fabric, paper or certain films. However, the lack of flexibility of the support structure prevents good stacking of rolls of non-uniform diameter, and adversely affects the stability of the stack thus formed. Furthermore, pallets with stacked roll stocks placed on these supports must generally be banded to keep the rolls from falling out of the stack. Thus, there is still a need for an inexpensive flexible cradle support structure for stacking roll stock, that is weather resistant, recyclable and suitable for stacking rolls with somewhat varying diameters. The present invention is directed to providing such a support.

DE 19908621A discloses rigidly connected cradle supports. The cradles can be come in sections that can be attached to each other.

EP 0706949A1 discloses triangular elastic wedges as supports for loads on palles.

SUMMARY OF THE INVENTION

It is an object of the present invention to provide a cradle support structure for stacking cylindrical structures such as roll stock, in horizontal tiers.

It is a further object of the present invention to provide a cradle support structure that can accommodate rolls of somewhat varying diameters, yet allow them to be stably stacked, without requiring banding.

A still further object of the present invention to provide a cradle support structure that lends itself to mass production, is cheap to manufacture, long-lasting and recyclable.

Another object of the present invention to provide a cradle support structure that may be fabricated from recycled polymer feedstock.

Yet another object of the present invention to provide a cradle support structure that may be easily affixed to a wooden pallet to provide a convenient base support for the bottom tier of a roll stock.

Still another object of the invention is to provide a method of manufacturing cradle support structures in accordance with the invention.

According to the present invention there is provided a roll stock cradle support structure for receiving and supporting one or more pieces of roll stock, comprising:

a flat base strip of rigid or semi-rigid plastic material having an upper and lower surface, at least one set of facing cradle portions of pre-selected dimensions integrally formed on one base strip surface, forming a roll support cradle, said cradle portions comprising a substantially vertical end wall and an arcuately shaped segments of rigid or semi-rigid plastic material, said segment being reinforced by members connecting the arcuately shaped segments with the end wall or base strip.

The cradle support structures have at least two or more support cradles, each comprising terminal cradle portions at the ends of the base strip and back to back cradle portions having their arcuate segments facing away from each other positioned between the terminal cradle portions. Preferably, the central back to back cradle portions are spaced apart with deformable plastic connecting segments. These deformable plastic connecting segments are preferably curved strips whose curvature is deformable under pressure. Generally, each cradle support structure will have between two and 10 support cradles.

The roll stock cradle support structure may have support cradles on one or both surfaces of the base strip and is preferably manufactured from polyolefin polymers, for example, polyethylene, polypropylene, and mixtures or copolymers of these. Most preferably the support structures are manufactured from recycled polymers, which is advantageous from an ecological point of view, and they are also cheaper. The dimensions of the cradles are such that the vertical height of the cradle is between 100 and 1000 mm, the width between 10 and 300 mm, and the arcuately shaped segments of the cradles have arc diameters of between 200 and 320 mm.

BRIEF DESCRIPTION OF THE DRAWINGS

The present invention will be further understood and appreciated from the following detailed description taken in conjunction with the drawings in which:

FIG. 3 is a side view of a cradle support structure having cradles on only one surface of the structure, FIG. 4 is a top view of the cradle support structure of FIG. 3, FIG. 5 is a side view of a cradle support structure having cradles on both surfaces of the structure.

DETAILED DESCRIPTION OF THE INVENTION

Figure 2:
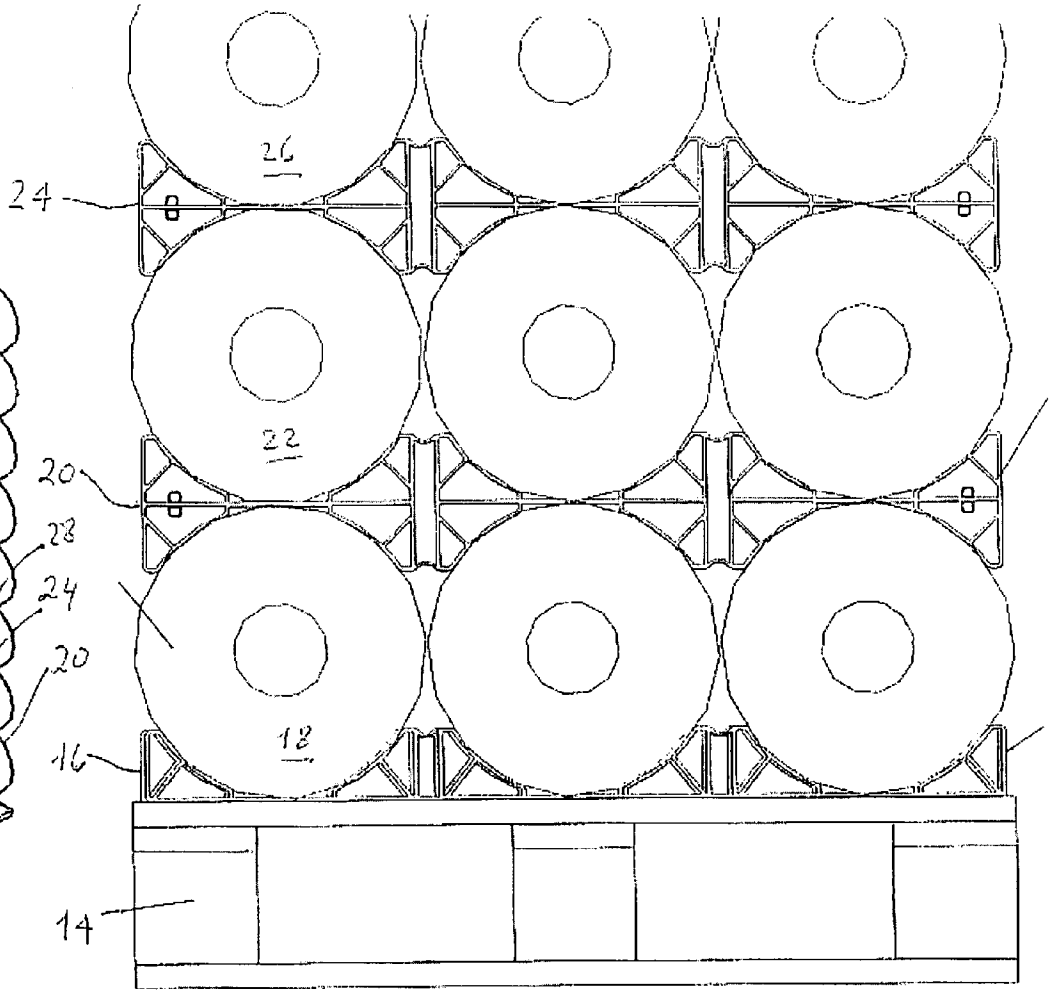
FIG. 2 is a blown up front view of the stacked roll stock of FIG. 1.
Figure 1:
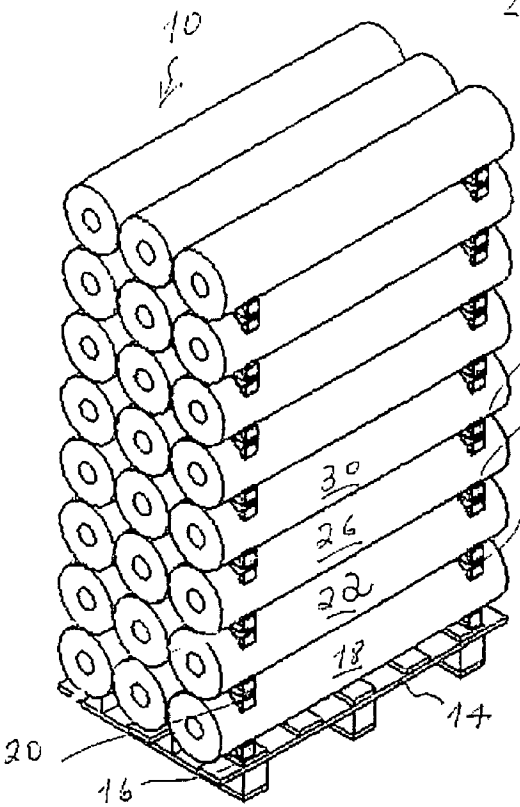
FIG. 1 is a perspective view of a stack or roll stock with cradle support structures in accordance with this invention.

Referring now to FIGS. 1 and 2, there is shown a multi-tiered stack 10 of rolls stacked on a pallet 14. The pallet 14 has affixed to its bottom a single-sided cradle support structure 16 onto which is placed a first row 18 of roll stock. Above this row 18 of roll stock is placed a double-sided support structure 20. Further alternating rows of rolls 22, 26, 30, etc. and double-sided support structures, 24, 28 etc. are added, thus forming a multi-tiered stack 10 of rolls. The stack is stable and will not topple, yet does not require banding.

FIGS. 3 to 5 illustrate one embodiment of the present invention. FIG. 3 shows a single-sided cylindrical support structure 16 consisting of a substantially flat base strip 32 which has integrally formed thereon left 34 and right 36 cradle end portions and complimentary center cradle portions 38 and 39 respectively. The cradle portions 34 and 38, and 36 and 39 have substantially vertical end walls 41 and arcuate shaped segments 40 and 42, and 44 and 46 facing each other, respectively, thus forming between them a cradle support.

Tangential reinforcing members 48 connect the arcuate segment 40 to its end walls 41, whereas reinforcing members 50 and 52 connect the arcuate segments with the base strip 32. The center cradle portions 38, 39 are slightly spaced apart 62 and are connected at their vertical ends by a curved strip of plastic 64 which is deformable when a heavy load is placed on the cradle, thereby making the arc of the cradle adjustable to the diameter and weight of the roll stock. The height of the end walls 41 of the cradle segments can range from 3 to 10 cm, preferably from 40 to 60 mm. The diameter 60 of the cradle is preferably in the range of 200 to 320 mm.

FIG. 5 illustrates a roll stock cradle 54, basically the same as in FIG. 3 with the exception that it also has cradle supports 56, 58 on the other side of the flat base strip 32.

Figure 6:
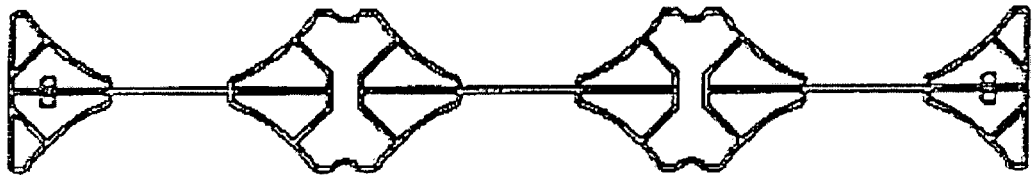
FIG. 6 illustrates another embodiment of a double sided cradle support structure in accordance with the invention.
Figure 7:
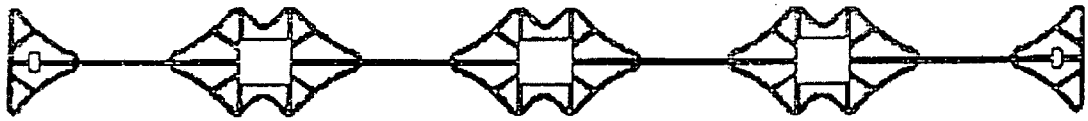
FIG. 7 is still another embodiment of a double sided cradle support structure according to the present invention.

The exact configuration of the single and the double-sided cylindrical support structures of the present invention can be adapted to particular applications, and loads, and several alternative configurations are illustrated in FIGS. 6 and 7.

The cylinder support structures of the present invention have several advantages over those of the prior art, notably the design of the cradle supports 56, 58 provides a flexibility that enables them to stack rolls of varying diameter safely, since the base strip is flexible and each cradle support operates independently. Several tiers of rolls can be thus stacked by alternating layers of rolls between double sided supports. Such stacked tiers are sturdy and do not generally require banding. The roll stock cradle supports may be used for stacking rolls of different lengths, diameters and weights.

The roll stock cradle supports of this invention are best manufactured by thermoforming, more specifically by injection molding. This produces a very satisfactory product with low production cost. Moreover, this method allows the use of recycled polymer, and the product can even be recycled further.

The thermoformed roll stock polymeric cradle support described hereinabove is tough and resistant to mishandling, stable in extremes of hot and cold, and resistant to moisture. By incorporating carbon black as a filler, for example, the plastic used may be made UV resistant and may be exposed to sunlight for many years. Unlike wooden or expanded polystyrene cradle supports, there is little danger of splintering or fragmenting.

It will be noted that when preparing a pallet for loading thereon roll stock, first the flat base strip of one sided roll stock cradle supports is fixed to the palate, using nails or staples for example, to provide a base layer for stacking a first row of roll stock. The roll stock is then arranged in parallel in the cradle supports and a double sided cradle support is placed on top of the rolls, and so on.

It is to be understood that the exact dimensions and shape of the different parts of the support structure may vary depending on the diameter, weight and length of the roll stock to be supported. The examples shown herein are for purposes of illustration only.

The invention claimed is:

1. Roll stock cradle support structure for receiving and supporting one or more pieces of roll stock, comprising:

a flat flexible base strip of rigid or semi-rigid plastic material having a longitudinal axis and an upper surface and a lower surface, at least one set of facing cradle portions of pre-selected dimensions integrally formed on top of and along the longitudinal axis of one flat base strip surface in a single row, with a section of flat base strip surface separating the facing cradle portions, thereby forming a roll support cradle, each cradle portion comprising a substantially vertical end wall and an arcuately shaped segment of rigid or semi-rigid plastic material, said segment being reinforced by members connecting the arcuately shaped segments with the end wall or base strip, said structure providing a flexibility due to the independent operation of the cradle portions and due to the flat plastic base strip between the cradle portions, allowing for roll stock of varying diameter sizes to be stacked securely.

2. A roll stock cradle support structure as in claim 1, having at least two support cradles formed on the one flat base strip surface, each structure comprising cradle portions which are terminal cradle portions at the ends of the base strip and at least one pair of back to back cradle portions having arcuate segments facing away from each other positioned between the terminal cradle portions, the facing cradle portions separated by a section of the flat base strip, said structure providing a flexibility due to the independent operation of each support cradle and the flat plastic base strip, allowing for stock of varying sizes to be stacked securely.

3. A roll stock cradle support structure as in claim 2, wherein the central back to back cradle portions are spaced apart with deformable plastic connecting segments.

4. A roll stock cradle support structure as in claim 3 wherein the deformable plastic connecting segments are curved strips whose curvature is deformable under pressure.

5. A roll stock cradle support structure as in claim 2, having between two and 10 support cradles.

6. A roll stock cradle support structure as in claim 1, having support cradles on both surfaces of the base strip with flat base strip sections separating facing cradle portions, and with cradle portions on the upper surface and cradle portions on the lower surface in opposed relationship.

7. A roll stock cradle support structure as in claim 1, wherein the plastic material is a polyolefin polymer.

8. A roll stock cradle support structure as in claim 7 wherein the plastic material is selected from the group consisting of polyethylene, polypropylene, mixtures or copolymers of polyethylene and polypropylene and recycled products of polyethylene and polypropylene.

9. A roll stock cradle support structure as in claim 1, wherein the arcuately shaped segment has an arc diameter of between 200 and 320 mm, and the vertical height of the cradle is between 100 and 1000 mm.

10. A method of manufacturing roll stock cradle support structures as claimed in claim 1 comprising providing a suitable mold and injection molding therein a thermoplastic polymer at predetermined temperature, cooling the mold and removing the support structure therefrom.

* * * * *